United States Patent [19]

Kakizoe

[11] Patent Number: 4,616,202

[45] Date of Patent: Oct. 7, 1986

[54] ELECTROMAGNETIC CONTACTOR

[75] Inventor: Masahiro Kakizoe, Tajimi, Japan

[73] Assignee: Mitsubishi Denki Kabushiki Kaisha, Tokyo, Japan

[21] Appl. No.: 799,763

[22] Filed: Nov. 19, 1985

[30] Foreign Application Priority Data

| | | | |
|---|---|---|---|
| Nov. 20, 1984 | [JP] | Japan | 59-174945[U] |
| Nov. 20, 1984 | [JP] | Japan | 59-174946[U] |
| Nov. 26, 1984 | [JP] | Japan | 59-178222[U] |
| Nov. 30, 1984 | [JP] | Japan | 59-180872[U] |
| Nov. 30, 1984 | [JP] | Japan | 59-180873[U] |

[51] Int. Cl.[4] ..... H01H 63/02; H01H 67/02

[52] U.S. Cl. ..... 335/133; 335/121; 335/128; 335/131; 335/132; 335/189; 335/191

[58] Field of Search ..... 335/121, 124, 128, 126, 335/127, 131, 132, 133, 189, 191

[56] References Cited

U.S. PATENT DOCUMENTS

| | | | |
|---|---|---|---|
| 2,897,316 | 7/1959 | Brauneck | 335/131 |
| 2,946,872 | 7/1960 | Siebers | 335/133 |
| 4,371,855 | 2/1983 | Lenzing | 335/132 |

*Primary Examiner*—E. A. Goldberg

*Assistant Examiner*—Lincoln D. Donovan

*Attorney, Agent, or Firm*—Armstrong, Nikaido, Marmelstein & Kubovcik

[57] ABSTRACT

An electromagnetic contactor having an electromagnet consisting of a fixed core and an operating coil mounted on the fixed core, a plurality of fixed contacts, a crossbar disposed above the fixed core, a plurality of contact bars associated with the crossbar and each provided with a pair of movable contacts located opposite the corresponding fixed contacts, respectively, a movable core joined to the lower portion of the crossbar opposite to the fixed core, and a rigid frame consisting of two parallel polygonal bars and two parallel connecting bars interconnecting the respective opposite ends of the polygonal bars. The crossbar and the movable core are supported pivotally on the rigid frame. One of the polygonal bars is supported rotatably at the opposite ends thereof in bearings provided on a stand, while the other polygonal bar is urged upward by springs so that the rigid frame will swing to bring the movable contacts into contact with the fixed contacts, respectively, when the operating coil is energized to attract the movable core to the fixed core.

9 Claims, 20 Drawing Figures

ELECTROMAGNETIC CONTACTOR

BACKGROUND OF THE INVENTION

The present invention relates to an electromagnetic contactor for establishing and interrupting the main power supply circuit of factories or a power supply circuit for a large-scale motor.

A conventional two-contact three-phase electromagnetic contactor employs an integrally formed three-phase crossbar which is movably provided for holding a movable core, wherein the motion of the crossbar is limited by the gap defined by the base plate fixedly mounted to hold the crossbar.

Therefore, simultaneous contact of the contacts of the three-phase contactors have been affected by the tilting of the crossbar within said gap. It is possible to perform a sliding adjustment of the crossbar in small-sized electromagnetic contactor within a range of allowance to practically negligible extent. In a large sized one, however, the crossbar having contacts for three phases are invariably formed integrally. As a result, the preciseness of the thus formed crossbar is affected to such an extent that the gap must be enlarged at the risk of expected simultaneous contact of the contacts for three phases due to the enlarged tilting of the crossbar.

The present invention is intended to solve the above problem and its object is to provide a large-sized electromagnetic contactor in which simultaneous contact of the three phase movable and fixed contacts is assured even if the three-phase crossbar is integrally formed.

SUMMARY OF THE INVENTION

Accordingly, the present invention has been made to solve those problems of the conventional two-contact type three-phase electromagnetic contactor.

It is an object of the present invention to provide a large capacity two-contact type three-phase electromagnetic contactor capable of bringing all the movable contacts thereof simultaneously into contact with the corresponding fixed contacts.

It is another object of the present invention to provide a large capacity two-contact type three-phase electromagnetic contactor having a frame of rigid construction for supporting one or a plurality of crossbars and a movable core, capable of ensuring the simultaneous contact of the movable contacts with the corresponding fixed contacts.

According to one aspect of the present invention, there is provided an electromagnetic contactor comprising: a base plate; a stand fixed to the base plate; an electromagnet consisting of a fixed core and an operating coil and disposed within the stand; a plurality of fixed contacts provided in the upper portion of the stand; a crossbar disposed above the fixed core; a plurality of contact bars each associated with the crossbar and provided with a pair of movable contacts so that the movable contacts are located opposite the corresponding fixed contacts, respectively; a movable core joined to the lower portion of the crossbar so as to be located opposite the fixed core; and a rigid frame consisting of two parallel polygonal bars and two parallel connecting bars interconnecting the respective opposite ends of the polygonal bars, and pivotally supporting the assembly of the crossbar and the movable core at the opposite ends of the movable core, wherein one of the polygonal bars is supported rotatably at the opposite ends thereof in bearings provided on one side of the stand, while the other polygonal bar is urged upward by springs so that the rigid frame is swingable on the former polygonal bar, slots and holes are formed in the respective opposite ends of the connecting bars, respectively, and the frame is assembled by fitting the respective opposite ends of the polygonal bars into the corresponding holes of the connecting bars and pressing the slotted outer ends of the connecting bars with screws so as to fasten the polygonal bars to the connecting bars.

According to another aspect of the present invention, there is provided an electromagnetic contactor comprising: a base plate; a stand fixed to the base plate; an electromagnetic consisting of a fixed core and an operating coil and disposed within the stand; a plurality of fixed contacts provided in the upper portion of the stand; a supporting case; a plurality of crossbars mounted on the supporting case and joined to the same with pins, respectively; a plurality of contact bars associated with the crossbars, respectively, and each provided with a pair of movable contacts so that the movable contacts are located opposite the corresponding fixed contacts, respectively; a movable core disposed within the supporting case and joined to the same with the pins joining the crossbars to the supporting case, so as to be located opposite the fixed core; and a rigid frame consisting of two parallel polygonal bars and two parallel connecting bars interconnecting the respective opposite ends of the polygonal bars, and pivotally supporting case at the opposite ends of the same, wherein one of the polygonal bars is supported rotatably at the opposite ends thereof in bearings provided on one side of the stand, while the other polygonal bar is urged upward by springs so that the rigid frame is swingable on the former polygonal bar, slots and holes are formed in the respective opposite ends of the connecting bars, respectively, and the frame is assembled by fitting the respective opposite ends of the polygonal bars into the corresponding holes of the connecting bars and pressing the slotted outer ends of the connecting bars with screws so as to fasten the polybonal bars to the connecting bars.

According to a further aspect of the present invention, there is provided an electromagnetic contactor of the same construction as that of either one of the above-mentioned electromagnetic contactors, except that the respective opposite ends of the connecting bars each has a stepped part provided with a U-shaped groove and the end of the corresponding polygonal bar is placed in the groove and fixed to the stepped part by screwing a member having the same U-shaped groove as that of the stepped part for receiving the polygonal bar to the stepped part of the connecting bar.

The above and other objects, features and advantages of the present invention will become more apparent from the following description of the preferred embodiments of the present invention taken in conjunction with the accompanying drawings.

DESCRIPTION OF THE PREFERRED EMBODIMENTS

Figure 1:
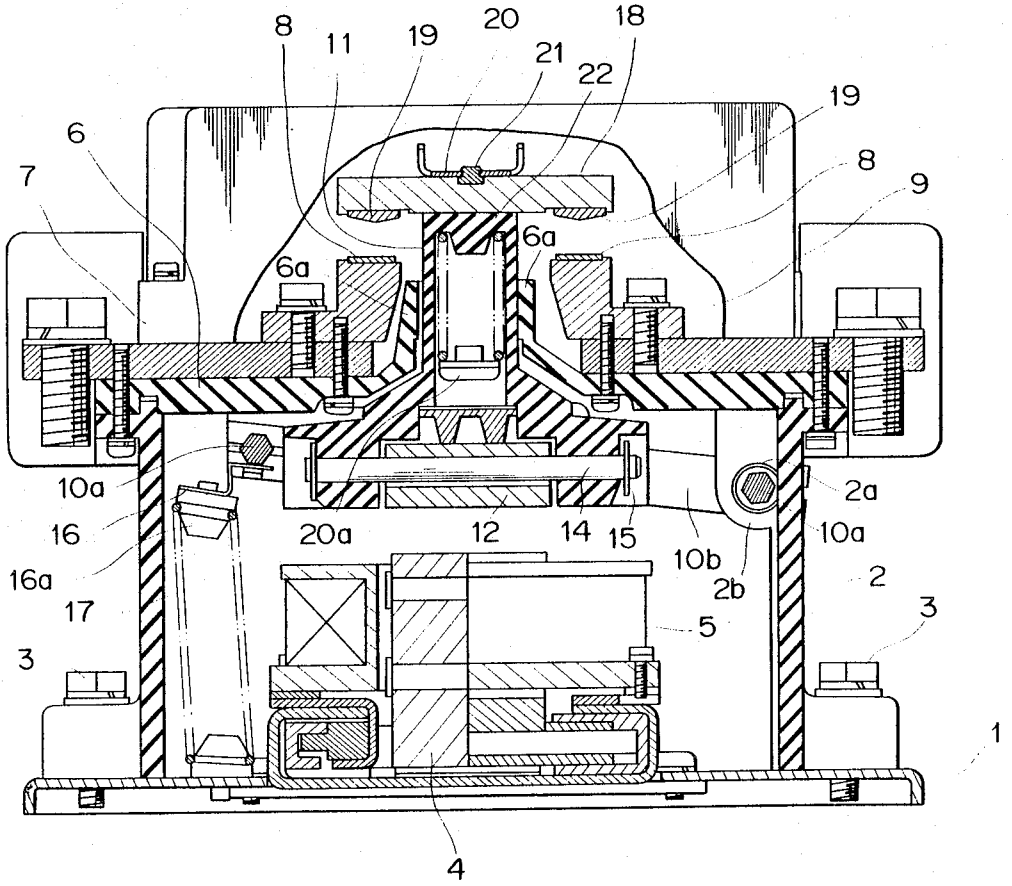
FIG. 1 is a longitudinal sectional view of an electromagnetic contactor, in a first embodiment, according to the present invention.
Figure 2:
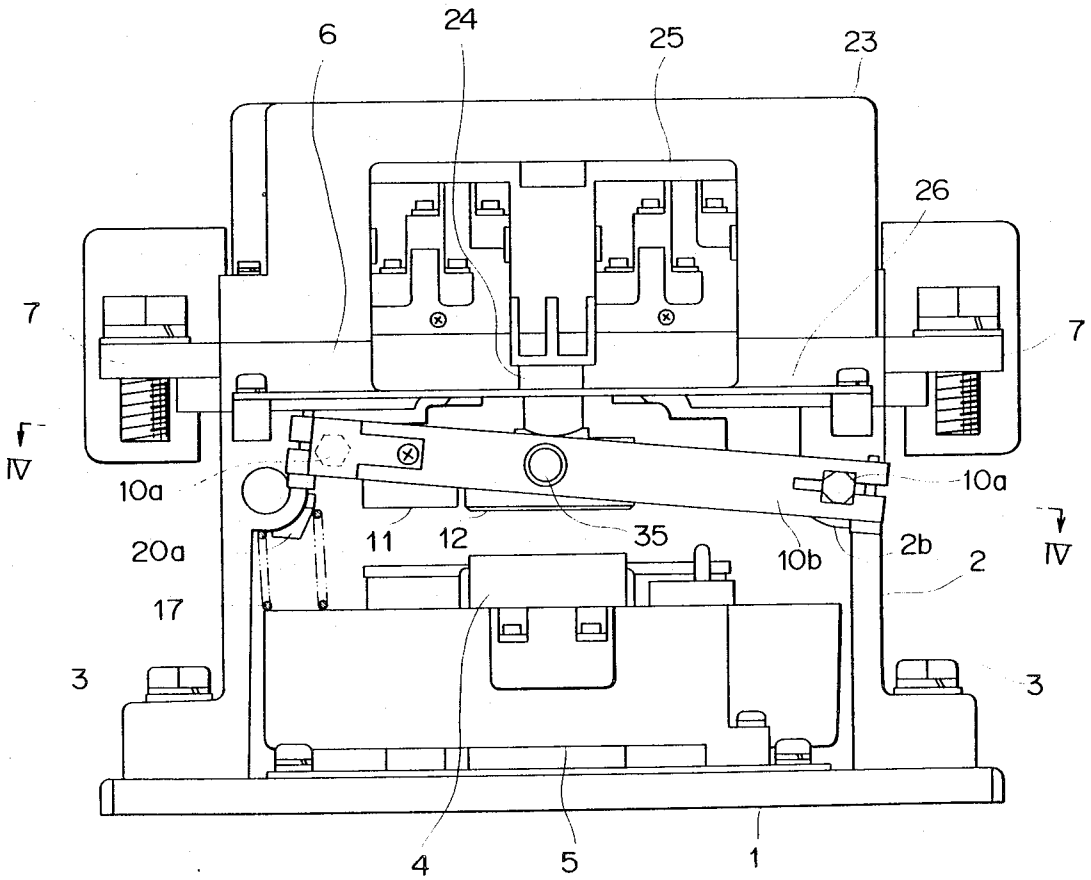
FIG. 2 is a side elevation of the electromagnetic contactor of FIG. 1, in a state where the contacts are disengaged.
Figure 3:
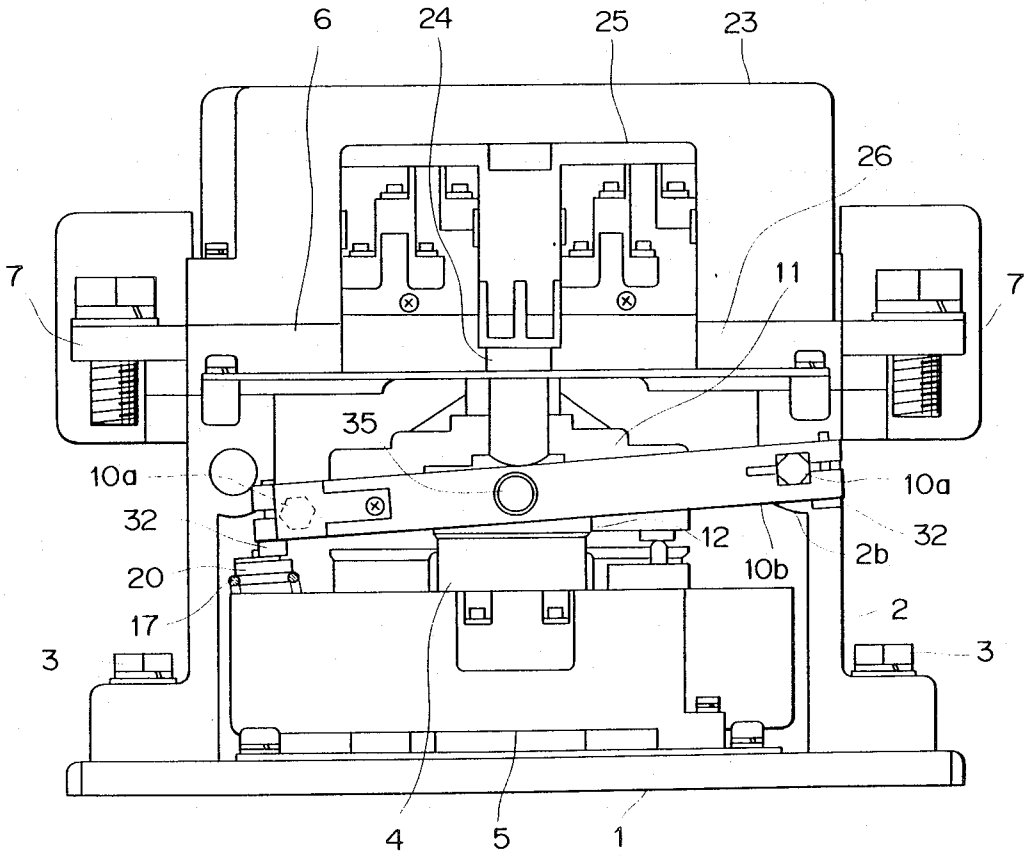
FIG. 3 is a side elevation of the electromagnetic contactor of FIG. 1, in a state where the contacts are engaged.
Figure 4:
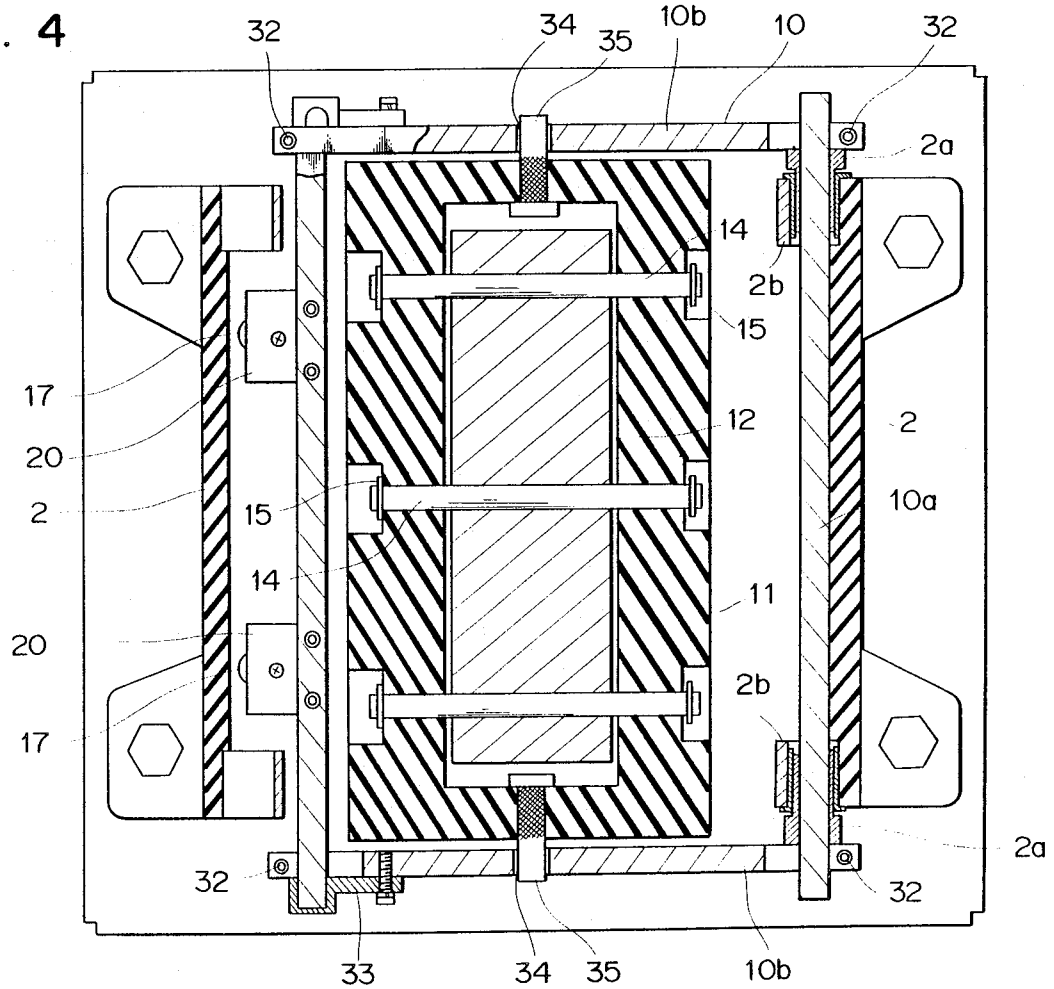
FIG. 4 is a sectional view taken along line IV—IV of FIG. 2.
Figure 5:
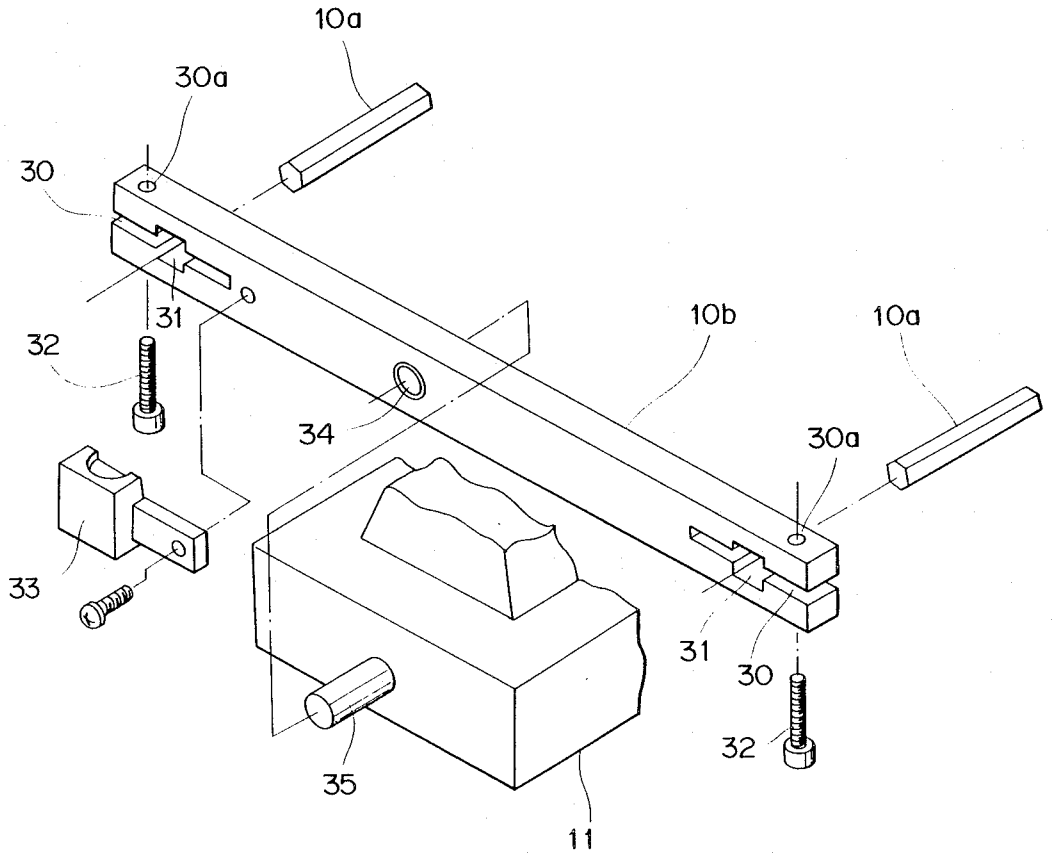
FIG. 5 is a fragmentary exploded perspective view of a frame employed in the electromagnetic contactor of FIG. 1.
Figure 6:
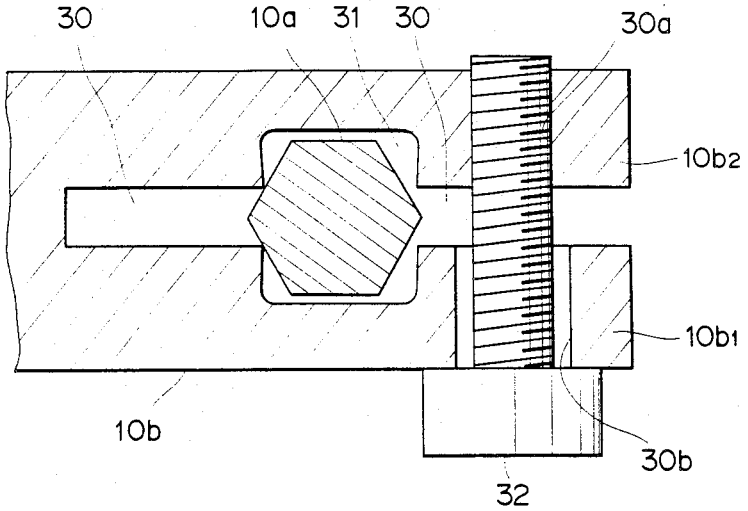
FIG. 6 is a fragmentary sectional view of a connecting bar employed in the first embodiment of FIG. 1, showing a bar fastening structure before fastening.

The preferred embodiemnts of the present invention will be described hereinafter in conjunction with the accompanying drawings, in which like reference characters designate like or corresponding parts throughout.

Referring to FIGS. 1 to 7 showing a first embodiment of the present invention, there are shown a base plate 1, an insulating stand 2 fastened to the base plate 1 with screws 3, an E-shaped fixed core 4 formed by laminating silicon steel plates, an operating coil 5 wound around the central leg of the fixed core 4, a top plate 6 attached to the upper end of the stand 2, crossbar guide walls 6*a* formed in the central portion of the top plate 6 so as to protrude upward, three pairs of terminal boards 7, namely, power supply terminal boards and load terminal boards, provided on the top plate 6 on opposite sides, respectively, with respect to the crossbar guide walls 6*a*, and a pair of fixed contacts 8, namely, a fixed power supply contact and a fixed load contact, attached through fixed contact bases 9 to each pair of the terminal boards, respectively.

A rectangular frame 10 consists of two parallel polygonal bars 10*a* and two parallel rectangular connecting bars 10*b* interconnecting the respective opposite ends of the polygonal bars, respectively. One of the polygonal bars 10*a* is supported pivotally at the opposite ends thereof in bearings 2*a* supported on supporting parts 2*b* of the stand 2. A single crossbar 11 for three phases is formed of a synthetic resin and is supported pivotally at the lower portion thereof between the respective central portions of the connecting bars 10*b* of the frame 11. There are also shown in FIGS. 1 to 7, a movable core 12 received in a hollow formed in the lower portion of the crossbar 11, three pins 14 joining the movable core 12 to the crossbar 11, stop clips 15 attached to the opposite ends of the pins 14, a spring receiver 16 having a spring seat 16*a* and attached to each connecting bar 10*b* on the free side of the frame 10, and a compression spring 17 extended between the spring seat 16*a* and a spring seat attached to the stand 2 so as to urge the frame 10 clockwise, as viewed in FIG. 1, namely, so as to move the movable core 12 away from the fixed core 4. Three movable contact bars 18 each having a pair of movable contacts 19 are mounted on top of the crossbar 13. A spring seat 20 is fixed at the upper portion thereof to the upper surface of each movable contact bar 18 with a rivet 21. A compression spring 22 is extended between the spring seat 20 and a spring seat 20*a* disposed below the spring seat 20 so as to press the movable contact bar 18 against the upper part of the crossbar 11.

Since the frame 10 is urged clockwise by the compression spring 17, the frame 10 is held at a predetermined upper position with the upper surface of the crossbar pivotally mounted on the frame 10 in contact with the top plate 6 while the operating coil 5 is not energized. In this state, the movable core 12 joined to the crossbar 11 is separated from and is held opposite to the fixed core 4, while a pair of the movable contacts 19 provided on each movable contact bar 18 are separated from and are held opposite to the corresponding fixed contacts 8 provided on the fixed contact base 9. The gap between the fixed contacts 8 and the movable contacts 19 is slightly smaller than the gap between the fixed core 4 and the movable core 12. Indicated at 23 is an arc box, at 24 is an auxiliary crossbar, at 25 is an auxiliary switch and at 26 is an auxiliary switch holding plate.

The manner of assembling the frame 10 and the mode of mounting the crossbar 11 on the frame 10 will be described in connection with FIGS. 4 to 7.

Figure 7:
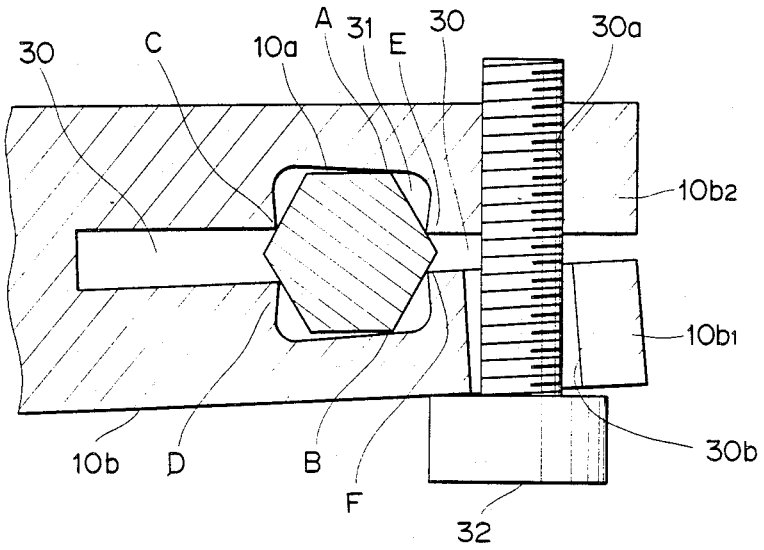
FIG. 7 is a view similar to FIG. 6, showing the bar fastening structure after fastening.

Slots 30 are formed in the opposite ends of each connecting bar 10*b* to bifurcate each end into a lower section $10b_1$ and an upper section $10b_2$. A square hole 31 is formed at the middle position of the slot 30. The length of the side of the square hole 31 is slightly greater than the width across the flats of the polygonal bar 10*a* and smaller than the width across the corners of the same. A bolt hole 30*b* is formed perpendicularly to the slot 30 in the outer portion of the lower section $10b_1$ and a threaded hole 30*a* is formed in alignment with the bolt hole 30*b* in the upper section 10*b*$_2$ of the connecting bar 10*b*. One end of the polygonal bar 10*a*, namely, a hexagonal bar in this embodiment, is inserted into the square hole 31 of the connecting bar 10*b*. Then, a screw 32 is screwed through the bolt hole 30*b* into the threaded hole 30*a* formed in the upper section 10*b*$_2$ to clamp the end of the polygonal bar 10*a* between the upper and lower sections 10*b*$_2$ and 10*b*$_1$ by forcibly bending the upper and lower sections so that the inner surfaces of the square hole 31 are pressed against the polygonal bar 10*a*. More specifically, since the outer portions of the upper and lower sections 10*b*$_2$ and 10*b*$_1$ are bent more than the inner portions of the same are bent, the square hole 31 is deformed into a trapezoidal shape, and hence the inner surfaces of the square hole 31 come into contact with the polygonal bar 10*b* along six lines A, B, C, D, E and F as illustrated in FIG. 7. That is, when the upper and lower sections 10*b*$_2$ and 10*b*$_1$ are bent, the inner surface of the square hole 31 are brought into contact with the two corners of the polygonal bar 10*a* along contact lines A and B, while edges formed between the inner surfaces of the square hole 31 and the surfaces of the slot 30 come into contact with the polygonal bar 10*a* along four contact lines C, D, E and F as illustrated in FIG. 7. Thus the end of the polygonal bar 10*a* is held firmly by the connecting bar 10*b* so as to extend at right angles to the connecting bar 10*b* by being clamped firmly between the upper and lower sections 10*b*$_2$ and 10*b*$_1$ formed in each end of the connecting bar 10*b*.

Pivots 35 projects from the respective central portions of the opposite side faces of the crossbar 11. The pivots 35 are incorporated into the crossbar 11 through insertmolding in forming the crossbar 11. The pivots 35 are fitted pivotally into bearing holes 34 formed in the respective middle position of the connecting bars 10*b* before assembling the frame 10 by fastening the respective opposite ends of the polygonal bars 10*a* to the respective opposite ends of the connecting bars 10*b*, respectively.

When an AC voltage is applied to the operating coil 5, the operating coil 5 generates magnetic flux, and thereby the movable core 12 is attracted by the magnetic attraction of the fixed core 4 to the fixed core 4 against the resilient force of the springs 17. Simultaneously, the crossbar 11 moves together with the movable core 12 toward the fixed core 4, and thereby a pair of the movable contacts 29 of each movable contact bar 18 held on the crossbar 11 come into contact with the corresponding fixed contacts 8. Since the gap between the movable core 12 and the fixed core 4 is greater than the gap between the movable contact 19 and the corresponding fixed contact 8, the movable core 12, hence the crossbar 11, moves further toward the fixed core 4 after the movable contact 19 has come into contact with the corresponding fixed contact 8. Consequently, the compression spring 22 is compressed, and hence the movable contacts 19 are pressed through the movable contact bar 18 against the corresponding fixed contacts 8 at a predetermined contact pressure.

Thus, when the movable core 12 is attracted against the resilient force of the compression springs 17 by the fixed core 4, the frame 10 mounted pivotally with the crossbar 11 and the movable core 12 is turned counterclockwise as the movable core 12 is attracted by the fixed core 4. If the attraction of the fixed core 4 acts irregularly, the movable core 12 tends to move in a tilted position. However, since the crossbar 11 joined to the movable core 12 is supported pivotally on the frame 10 and the tortional regidity of the frame 10 tends to correct the tilt of the movable core 12 through the crossbar 11, the movable core 12 moves toward the fixed core 4 in the correct position. Accordingly, all the movable contacts 19 of the movable contact bars 18 mounted on top of the crossbar 11 come simultaneously into contact with the corresponding fixed contacts 8.

When the operating coil 5 is de-energized, the magnetic attraction of the fixed core 4 acting on the movable core 12 is nullified. Consequently, the frame 10 is turned clockwise by the resilience of the compressed compression springs 17, and thereby the crossbar 11 combined with the movable core 12 and pivotally supported on the frame 10 is moved away from the fixed core 4, and hence the movable contacts 19 are separated from the corresponding fixed contacts 8 and are returned to the original position.

As described hereinbefore, in this embodiment, the crossbar combined with the movable core is supported pivotally on the connecting bars of the rigid frame formed by interconnecting the respective opposite ends of the two parallel polygonal bars by the two parallel connecting bars. Therefore, even if the magnetic attraction of the fixed core 4 acts irregularly on the movable core 12 to tilt the movable core 12, the tilt of the movable core 12 is corrected by the torsional rigidity of the connecting bars 10*b*, and hence all the movable contacts provided on the crossbar are brought simultaneously into contact with the corresponding fixed contacts.

A second embodiment of the present invention will be described hereinafter in connection with FIGS. 8 to 12.

Basically, the construction of the second embodiment is similar to that of the first embodiment, except that the second embodiment includes three individual crossbars and a supporting case for pivotally incorporating the three crossbars and a movable core to a rigid frame, hence to avoid duplication only the construction and components specific to the second embodiment will be described hereinafter and the description of those similar to or the same as those of the first embodiment will be omitted.

Figure 8:
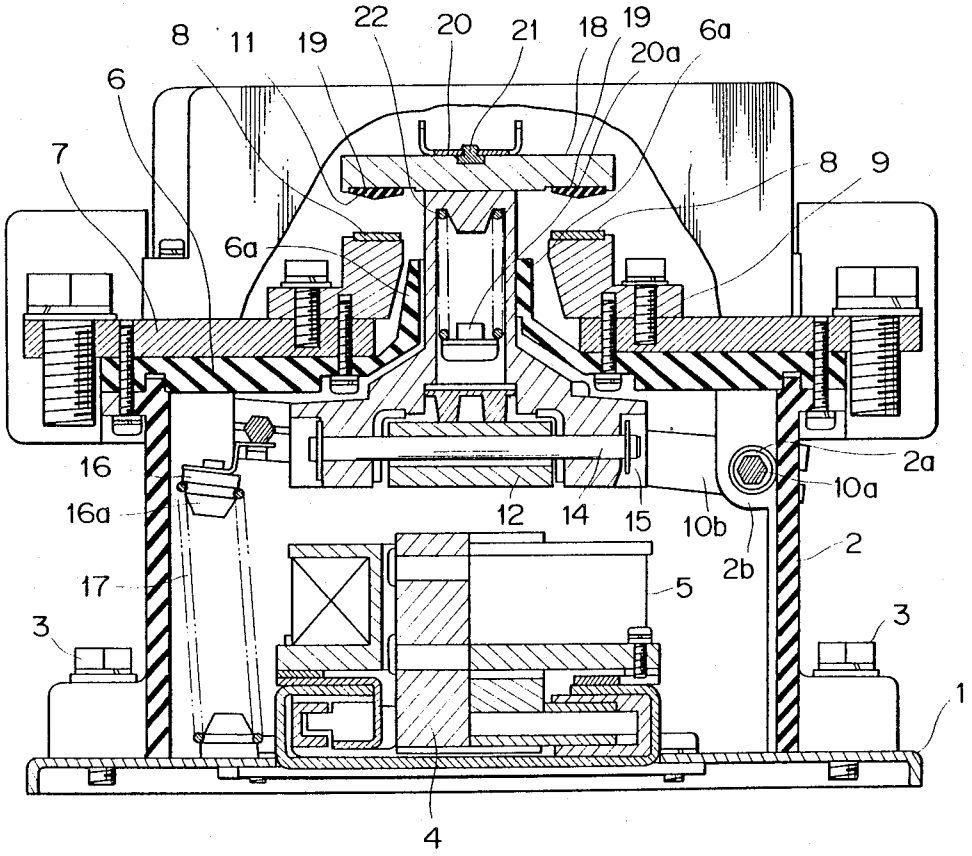
FIG. 8 is a longitudinal sectional view of an electromagnetic contactor, in a second embodiment, according to the present invention.
Figure 9:
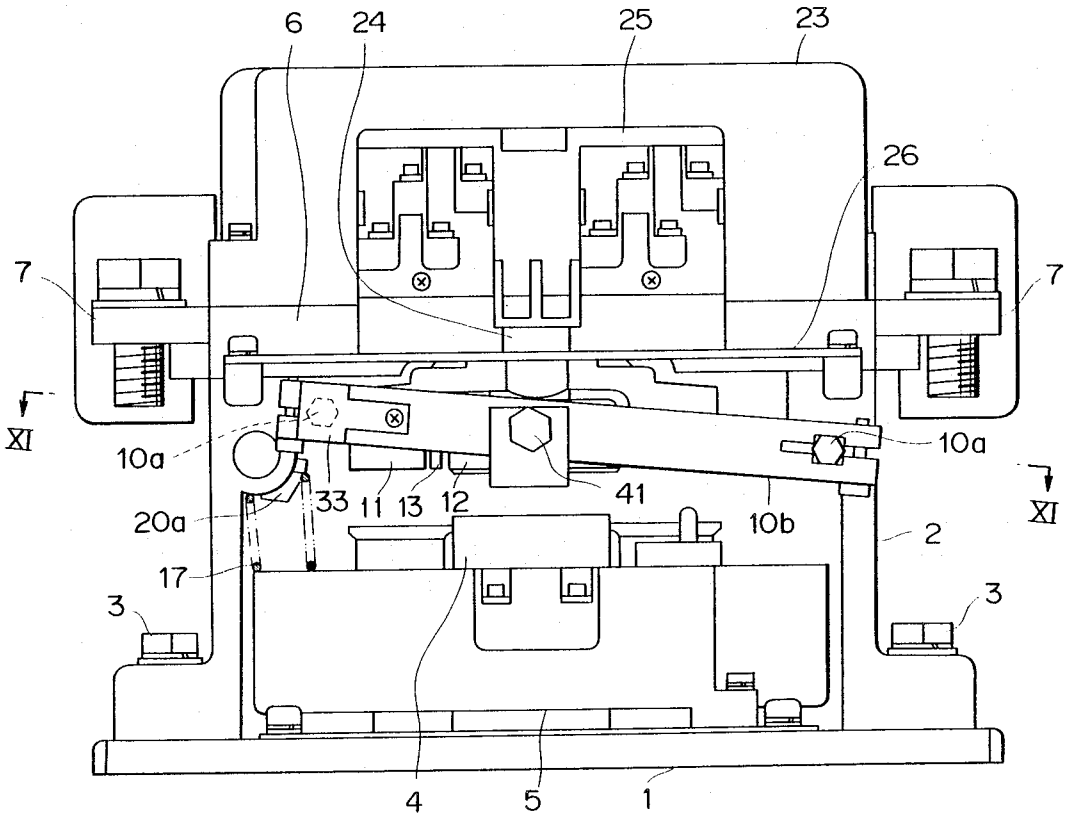
FIG. 9 is a side elevation of the electromagnetic contactor of FIG. 8, in a state where the contacts are disengaged.
Figure 10:
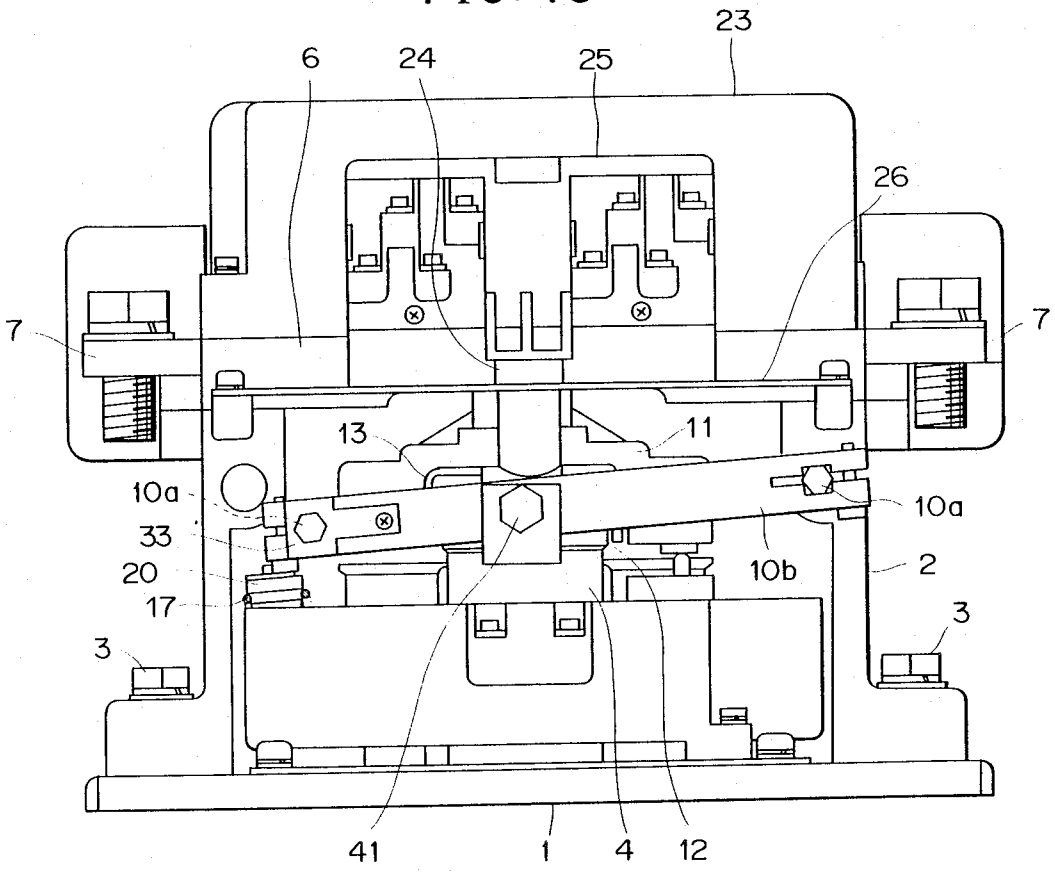
FIG. 10 is a side elevation of the electromagnetic contactor of FIG. 8, in a state where the contacts are engaged.
Figure 11:
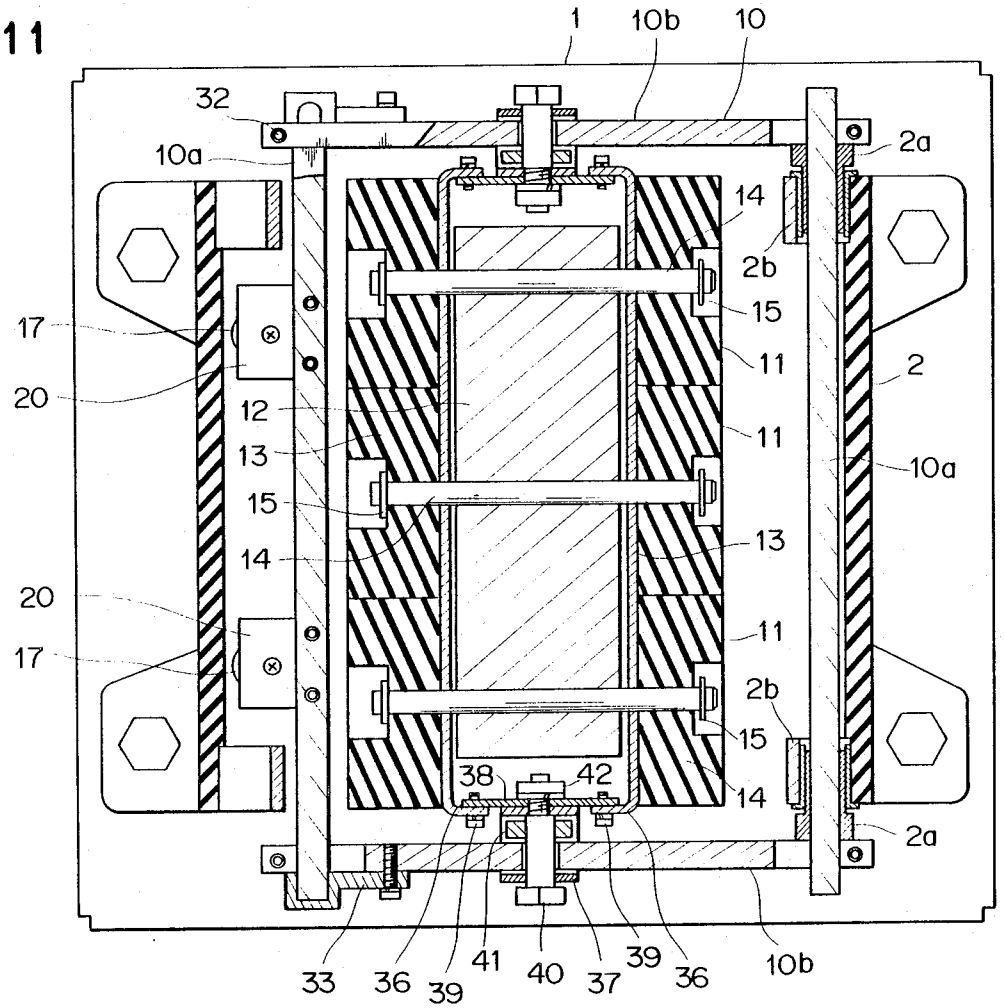
FIG. 11 is a sectional view taken along line XI—XI of FIG. 9.

Referring to FIGS. 8 and 11, a supporting case 13 is mounted pivotally on a frame 10 so as to extend between the connecting bars 10*b* of the frame 10. A movable core 12 is accommodated in the supporting case 13, while three insulating crossbars 11 are mounted side by side on the supporting case 13 so as to receive the supporting case 13 in the respective bottom portions thereof. The movable core 12 and the three crossbars 11 are joined to the supporting case 13 with three pins 14, respectively. Indicated at 15 are stop clips attached to the opposite ends of the pins 14 to hold the three crossbars 11 and the movable core in place on the supporting case 13.

Figure 12:
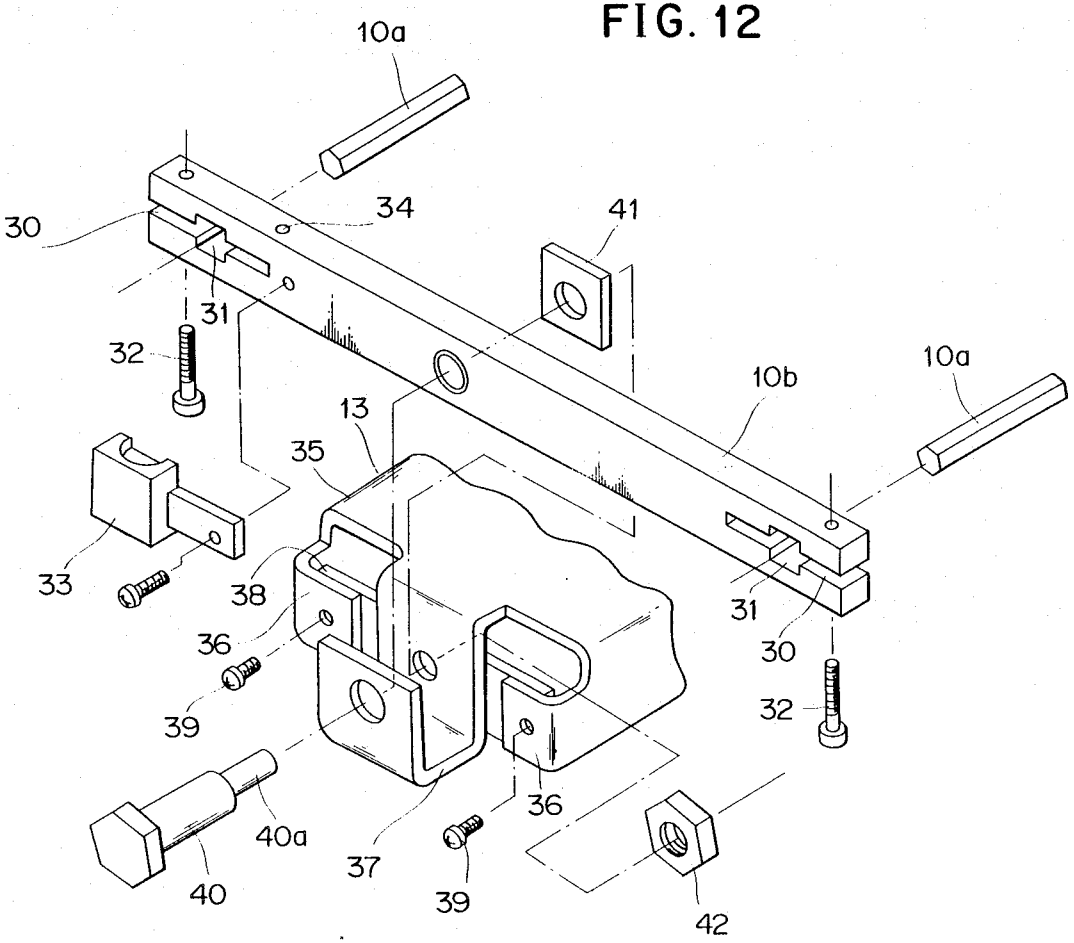
FIG. 12 is a fragmentary exploded perspective view of the frame employed in the second embodiment of FIG. 8.

As illustrated in FIG. 12, the supporting case 13 has a body section 35 having the form of a box, a pair of opposite end walls 36 formed in each end portion of the body section 35 by bending the extremities of the side walls inward. A U-shaped supporting section 37 is formed at each longitudinal end of the body section by bending the extremity of the upper wall of the body section 35. A reinforcement 38 are screwed to the end walls 36 with screws 39. In mounting the supporting case 13 pivotally on the frame 10, the respective central portions of the connecting bars 10*b* and spacers 41 are received in the supporting section 37, and then a bolt 40 is inserted through each supporting section 37, the connecting bar 10*b*, the spacer 41 and the reinforcement 38 in running fit and a hexagonal nut 42 is screwed on the threaded portion 40*a* of the bolt 40.

In this embodiment, when the operating coil 5 is energized to attract the movable core 12 against the resilient force of the compression springs 17 by the fixed core 4, the frame 10 pivotally mounted with the supporting case 13 integrally carrying the crossbars 11 and the movable coil 12 is turned counterclockwise as the movable core 12 is attracted by the fixed core 4. Since the movable core 12 and the three crossbars 11 are joined to the supporting case 13 with the pins 14, three crossbars 11 are moved simultaneously toward the fixed core 4. If the attraction of the fixed core 4 acts irregularly on the movable core 12, namely, if the attraction acts more strongly on one side than on the other side of the movable core 12, the movable core 12 tends to move diagonally. However, since the supporting case 13 mounted with the movable core 12 is supported pivotally on the frame 10 and the tilt of the movable core 12 is corrected through the supporting case 13 by the torsional resilience of the frame 10, the movable core 12 moves normally toward the fixed core 4. Accordingly, the movable contacts 19 of the movable contact bars 18 mounted on top of the crossbars 11, respectively, are brought simultaneously into contact with the corresponding fixed contact 8.

When the operating coil 5 is de-energized, the magnetic attraction of the fixed core 4 acting on the movable core 12 is nullified. Consequently, the frame 10 is turned clockwise by the resilience of the compressed compression springs 17, and thereby the crossbars 11 and the movable core 12 joined to the supporting case 13 pivotally mounted on the frame 10 are moved away from the fixed core 4, and hence the movable contacts 19 are separated from the corresponding fixed contacts 8 and are returned to the original position.

As described hereinbefore, in the second embodiment, the movable core 12 is accommodated in the supporting case 13, the three crossbars 11 are mounted on the supporting case so as to receive the supporting case 13 in the respective recesses formed in the respective lower portions of the crossbars 11, respectively, and the movable core 12 and the crossbars 11 are joined to the supporting case 13 by inserting the pins 14 through the crossbars 11, the supporting case 13 and the movable core 12 and attaching the stop clips to the respective opposite ends of the pins 14. Accordingly, the crossbars 11, the movable core 12 and the supporting case 13 can be simply assembled. Furthermore, since the second embodiment is provided with three individual crossbars 11 each for one phase, the mold for molding the crossbars 11 is inexpensive, and thereby the crossbars can be manufactured at a low manufacturing cost.

A third embodiment of the present invention will be described hereinafter in connection with FIGS. 13 and 14.

Basically, the construction and the performance of the third embodiment are similar to those of the second embodiment, except that the third embodiment has a hole formed in one of the connecting bars of the frame for receiving the tip of a screwdriver or the like to turn the frame so that the movable contacts are brought into contact with the corresponding fixed contacts for testing, hence to avoid duplication only the construction and components specific to the third embodiment will be described hereinafter and the description of those similar to or the same as those of the second embodiment will be omitted.

In this embodiment, the tip of a screwdriver is applied to a hole formed in one of the connecting bars 10*b* on the free side of the frame 10 and the screwdriver is pushed to turn the frame 10 counterclockwise to bring the movable contacts into contact with the corresponding fixed contacts for testing. Since the distance between the center of turning of the frame and the hole for receiving the tip of a screwdriver is greater than the distance between the same center and the center of the movable core, from the principle of leverage, the force required for pressing down the screwdriver to turn the frame counterclockwise is smaller than the magnetic attraction of the fixed core to attract the movable core, and hence the frame can be easily turned manually.

Figure 13:
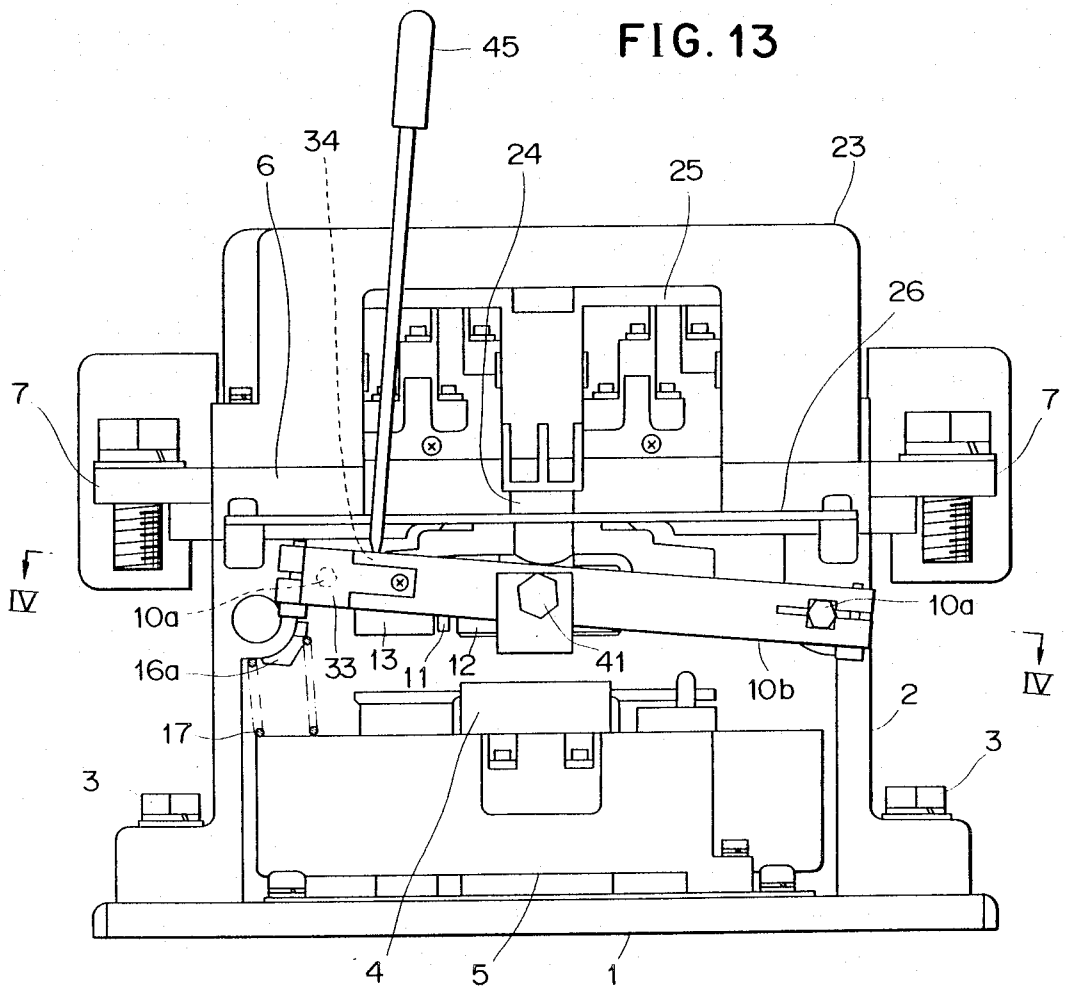
FIG. 13 is a side elevation of an electromagnetic contactor, in a third embodiment, according to the present invention.
Figure 14:
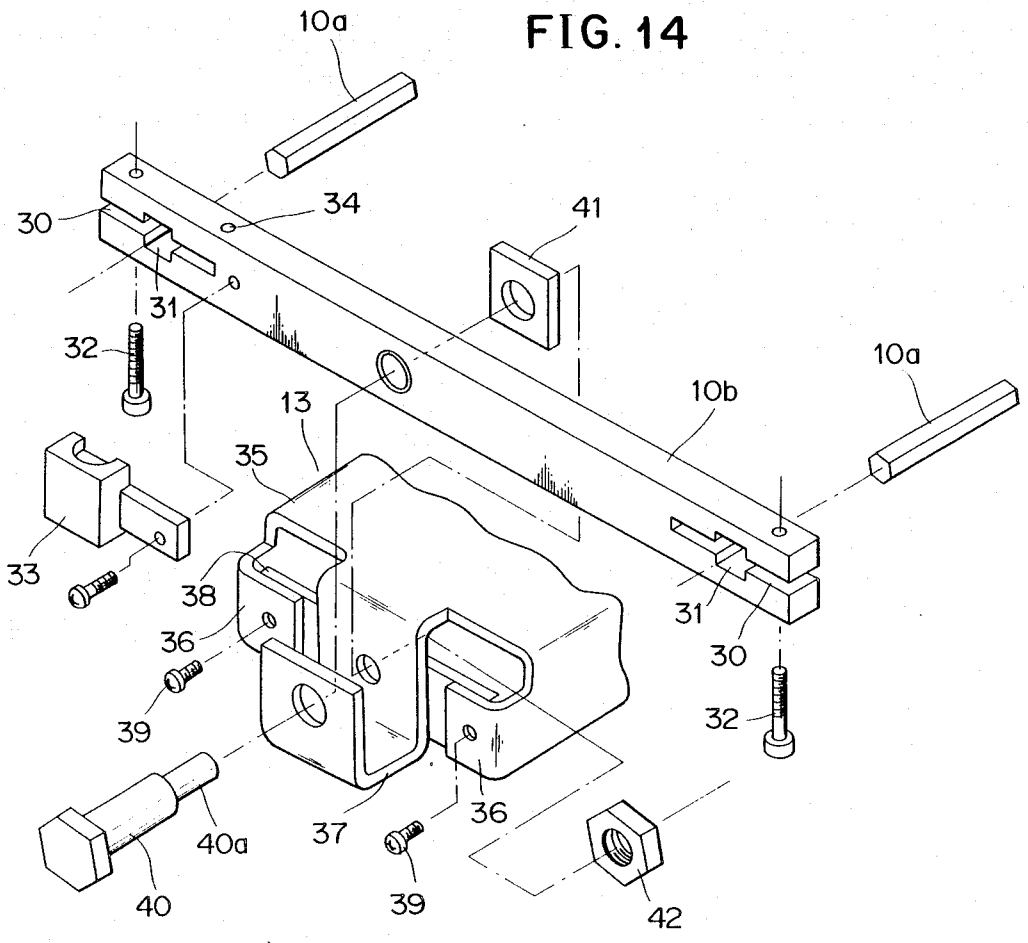
FIG. 14 is a fragmentary exploded perspective view of the frame employed in the third embodiment of FIG. 13.
Figure 15:
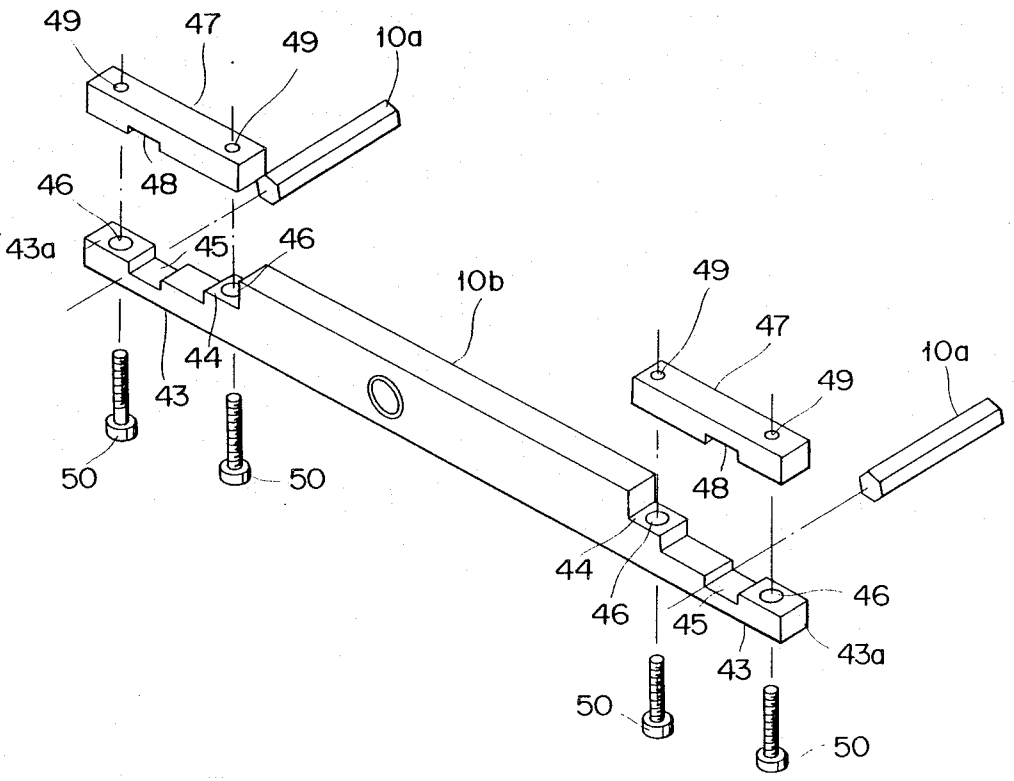
FIG. 15 is an exploded perspective view of a connecting bar of the frame of a fourth embodiment of the present invention, showing a bar fastening structure.
Figure 16:
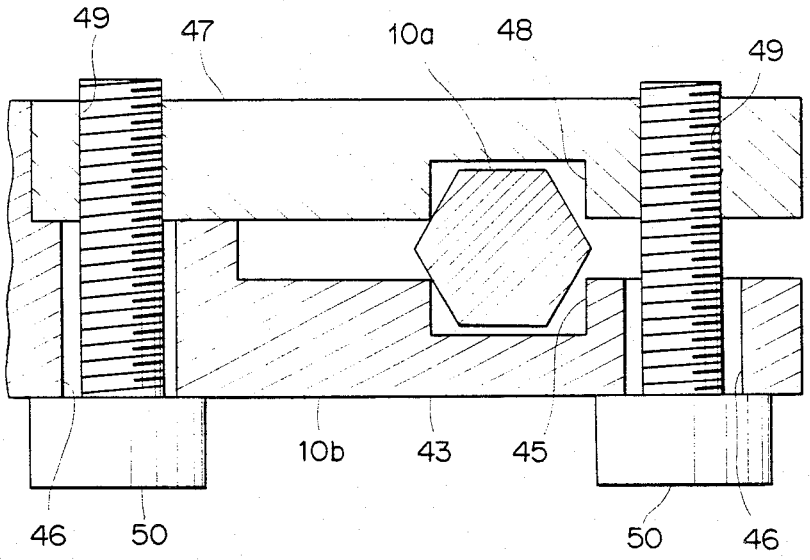
FIG. 16 is a fragmentary sectional view of the clamping structure of a connecting bar in a state before clamping a polygonal bar.

Referring to FIGS. 13 and 14, in order to bring the movable contacts into contact with the corresponding fixed contacts by manually moving the movable core 12 toward the fixed core 4 to test the sequence circuit with which the electromagnetic contactor is associated, the frame 10 is turned counterclockwise against the resilient force of the compression springs 17 by applying the tip of a screwdriver to the hole 34 formed in the connecting bar 10*b* on the free side of the frame 10 and pressing the screwdriver so as to move the movable core 12 toward the fixed core. Then, the frame 10 mounted with the crossbars 11, the supporting case 13 and the movable core 12 is turned counterclockwise, and thereby the movable contacts 19 of the movable contact bars 19 mounted on the crossbars 11, respectively, are brought into contact with the corresponding fixed contacts 8, respectively. The force necessary to turn the frame 10 against the resilient force of the compression springs 17 is smaller than the electromagnetic attraction of the fixed core 4, hence the frame 10 can be easily turned counterclockwise by pressing the connecting bar 10*b* with the screwdriver.

As mentioned above, since the distance between the center of turning of the frame 10 and the hole 34 for receiving the tip of a screwdriver is greater than the distance between the same center and the center of the movable core 12, from the principle of leverage, the force required for pressing down the screwdriver to turn the frame 10 counterclockwise is smaller than the magnetic attraction of the fixed core 4 to attract the movable core, and hence the frame 10 can be easily turned manually as compared with turning a conventional assembly of links, crossbars and a movable core supported on the free ends of the links.

In the third embodiment, the hole 34 for receiving the tip of a screwdriver is formed in one of the connecting bars 10*b* on the free side of the frame 10 in the vicinity of the junction of the connecting bar 10*b* and the polygonal bar 10*a*, however, naturally, the hole 34 may be formed in the polygonal bar 10*a* on the free side of the frame 10 in the vicinity of the junction of the connecting bar 10*b* and the polygonal bar 10*a* or in an end plate 33 attached to the connecting bar 10*b* on the free side of the frame 10 in the vicinity of the junction of the connecting bar 10*b* and the polygonal shaft 10*a* to receive the end of the polygonal shaft 10*a*.

Furthermore, although the third embodiment is provided with three crossbars 11 arranged side by side, however, these three crossbars 11 may be substituted by a large single crossbar.

A fourth embodiment of the present invention will be described hereinafter in connection with FIGS. 15 to 18.

Basically, the construction and the performance of the fourth embodiment are similar to those of the first or second embodiment of the present invention, except that the construction of the frame 10 is different from that of the frame of the first or second embodiment, hence to avoid duplication only the construction and components specific to the fourth embodiment will be described hereinafter and the description of those similar to or the same as those of the first or second embodiment will be omitted.

Prior to the description of the fourth embodiment, problems in machining the connecting bar 10*b* of the frame 10 employed in the first or second embodiment will be explained.

Figure 19:
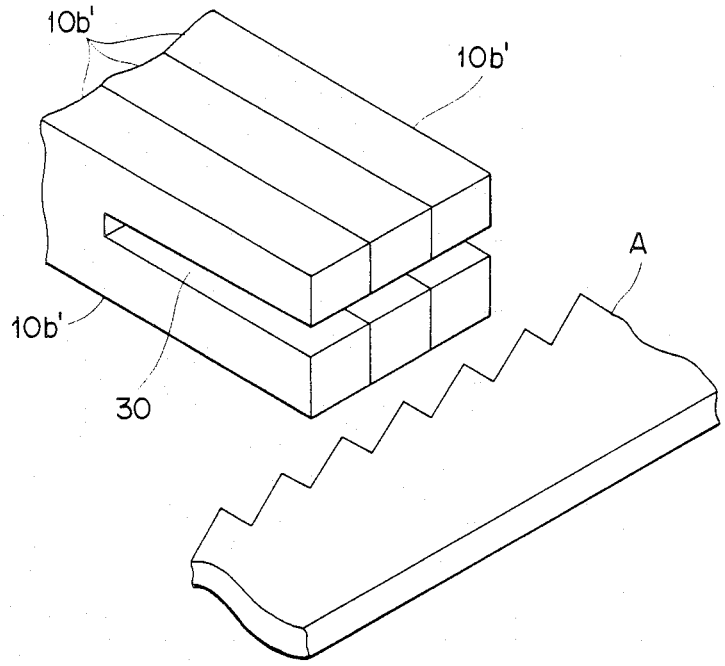
FIG. 19 is a perspective view of end portions of connecting bars employed in the first, second and third embodiments of the present invention for assistance in explaining the manner of machining the end portions to form slots therein.
Figure 20:
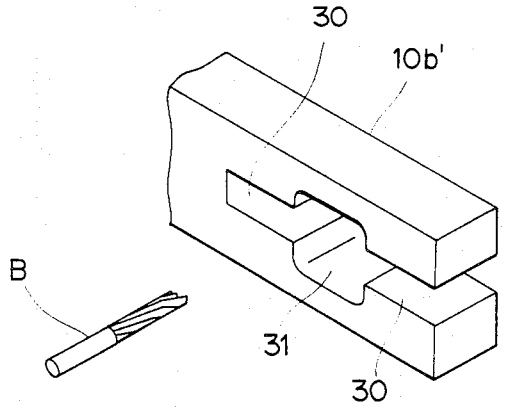
FIG. 20 is a perspective view of the end portion of a connecting bar employed in the first, second and third embodiments of the present invention for assistance in explaining the manner of machining the end portion to form a hole therein.

In forming the slot 30 in each end of the connecting bar 10*b*, a plurality of flat steel bars 10*b*′,i.e., materials of the connecting bars 10*b*, arranged side by side as illustrated in FIG. 19 and the respective ends of the flat steel bars 10*b*′ are slotted with a saw blade A to form the slots 30 in each end of each flat steel bar 10*b*′. Then, the square hole 31 for receiving the end of the polygonal bar 10*a*, a hexagonal bar in this embodiment, is formed in the middle of each slot 30 with a mill B as illustrated in FIG. 20. When the hole 31 is machined with the mill B, the corners of the hole 31 are inevitably rounded. If the radius of the rounded corners of the hole 31 is excessively large, it is impossible to insert the polygonal bar 10*a* into the hole 31. Therefore, only a mill having an extremely small diameter as compared with the size of the hole 31 is applicable to forming the hole 31. The connecting bars 10*b* employed in the fourth embodiment can be machined efficiently with a mill of any size at a low manufacturing cost.

The frame 10 of the fourth embodiment will be described hereinafter. Referring to FIGS. 15 to 18, indicated at 10*a* is a polygonal bar, i.e., a hexagonal steel bar in this embodiment and at 10*b* is a connecting bar, i.e., a flat steel bar is this embodiment, for interconnecting the ends of the two parallel polygonal bars 10*a*. A clamping section 43 is formed in each end of the connecting bar 10*b* by milling substantially the half portion of the end of the connecting bar 10*b* with a mill. Indicated at 44 is an upper land formed at the inner end of the clamping section 43 and at 43*a* is a lower land extending outward from the outer shoulder of the upper land 44. A groove 45 for receiving the polygonal bar 10*a* is formed practically at the middle of the lower land 43*a* so as to extend perpendicularly to the longitudinal axis of the connecting bar 10*b*. Bolt holes 46 are formed in the upper land 44 and the outer end of the lower land 43*a* of the clamping section 43. A clamping plate 47 to be combined with the clamping section 43 of the connecting bar 10*b* is formed by cutting a flat bar of a size practically the same as that of the clamping section 43. A groove 48 for receiving the polygonal bar 10*a* is formed at the middle of the clamping plate 47 so as to extend widthwise of the clamping plate 47. Threaded holes 49 are formed in the opposite ends of the clamping plate 47 so as to be aligned with the bolt holes 46, respectively, when the clamping plate 47 is attached to the clamping section 43 of the connecting bar 10*b*. Screws 50 are inserted through the bolt holes 46 and screwed into the threaded holes 49, respectively, to clamp the polygonal bar 10*a* between the clamping plate 47 and the clamping section 43.

Figure 18:
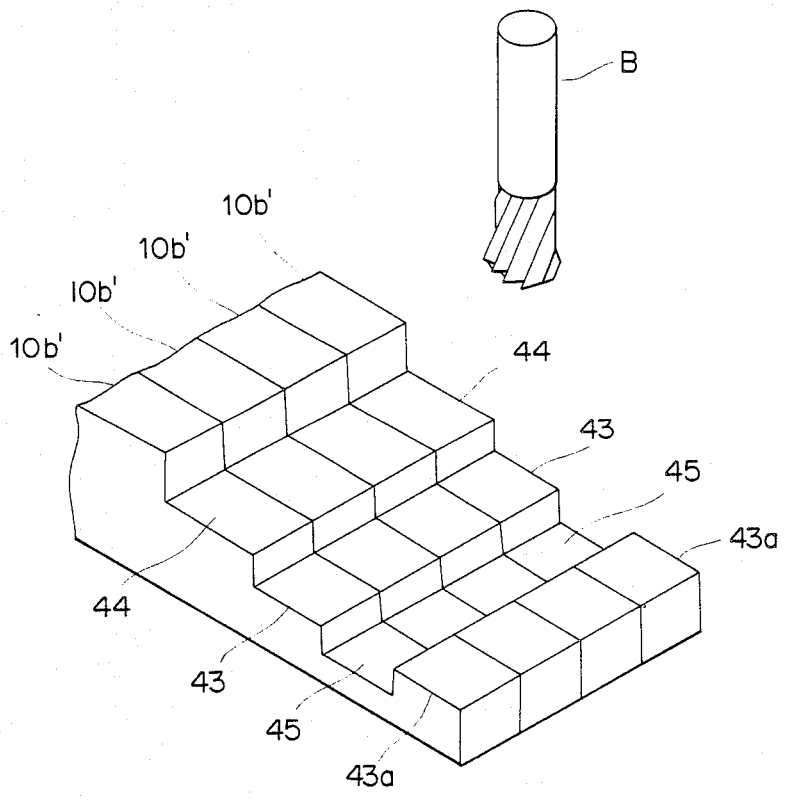
FIG. 18 is a perspective view of the clamping sections of connecting bars for assistance in explaining the manner of machining the ends of the connecting bars.

In machining the end of the connecting bar 10*b* to form the clamping section 43 consisting of the upper land 44, the lower land 43*a* and the groove 45, a plurality of the connecting bars 10*b*, for example, four connecting bars 10*b*, are arranged side by side as illustrated in FIG. 18, then the ends of the connecting bars 10*b* are machined by a depth corresponding to the level of the upper land 44 with a mill B, then the area other than that corresponding to the upper lands 44 is machined with the mill B to form the lower land 43*a*, and then the grooves 45 are cut in the lower lands 43*a* with the mill B. When the diameter of the mill B is not greater than the width of the grooves 45, the upper lands 44, the lower lands 43*a* and the grooves 45 can be machined with the same mill.

Although not illustrated, the grooves 48 are formed simultaneously by arranging a plurality of the clamping bars 47 side by side and machining the clamping plates 47 similarly to machining the clamping sections 43 with the mill B.

Figure 17:
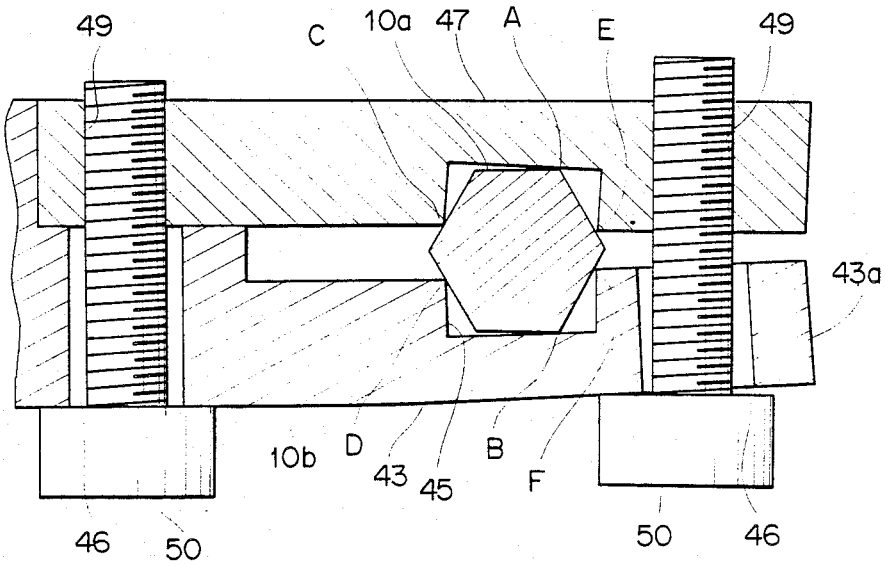
FIG. 17 is a fragmentary sectional view of the clamping structure of FIG. 16 in a state after clamping the polygonal bar.

The polygonal bar 10*a* is fixed to the connecting bar 10*b* in the following manner. The end of the polygonal bar 10*a* is fitted into the groove 45 formed in the clamping section 43 of the connecting bar 10*b*, and then the clamping plate 47 is placed on the clamping section 43 with the inner end thereof seated on the upper land 44 of the clamping section and the groove 48 thereof receiving the polygonal bar 10*a* therein. The bolt 50 is inserted through the bolt hole 46 formed through the upper land 44 and screwed into the threaded hole 49 of the clamping plate 47 to fasten the clamping plate 47 to the upper land 44 of the clamping section 43, and then the screw 50 is inserted through the bolt hole 46 formed in the outer end of the lower land 43*a* and is screwed into the corresponding threaded hole 49 of the clamping plate 47. As the latter screw 50 is screwed into the threaded hole 49, the clamping section 43 and the clamping plate are bent toward each other, so that the inner surfaces of the groove 45 of the clamping section 43 and the groove 48 of the clamping plate 47 are pressed firmly against the surface of the polygonal bar 10*a*, and thereby the end of the polygonal bar 10*a* is clamped firmly between the clamping section 43 and the clamping plate 47. Since the bend of the clamping section 43 and the clamping plate 47 increases toward the outer ends of the clamping section 43 and the clamping plate 47, the square hole formed by the grooves 45 and 48 is deformed into a trapezoidal hole. Consequently, as shown in FIG. 17, the clamping section 43 of the connecting bar 10*b* and the clamping plate 47 are brought into contact with the polygonal bar 10*a*, namely, the hexagonal bar, along six lines A, B, C, D, E and F. Thus the respective ends of the polygonal bar 10*a* and the connecting bar 10*b* are joined firmly together at right angles and it is impossible for the polygonal bar 10*a* to move in the groove 45 of the clamping section 43 and the groove 48 of the clamping plate 47, even if a vertical or a lateral force is applied to the polygonal bar 10*a*.

Although the invention has been described with reference to the preferred embodiment thereof with a certain degree of particularity, it is to be understood to those skilled in the art that various changes and modifications may be made in the invention without departing from the spirit and scope thereof.

What is claimed is:

1. An electromagnetic contactor comprising: a base; a stand fixed to the base plate; an electromagnet consisting of a fixed core and an operating coil mounted on the fixed core, and disposed within the stand; a plurality of fixed contacts provided in the upper portion of the stand; a crossbar disposed above the fixed core; a plurality of contact bars each associated with the crossbar and provided with a pair of movable contacts so that the movable contacts are located opposite the corresponding fixed contacts, respectively; a movable core joined to the lower portion of the crossbar so as to be located opposite fixed core; and a rigid frame consisting of two parallel polygonal bars and two parallel connecting bars interconnecting the respective opposite ends of the polygonal bars, and pivotally supporting the assembly of the crossbar and the movable core at the opposite ends of the movable core, wherein one of the polygonal bars is supported at the opposite ends thereof in bearings provided on one side of the stand, while the other polygonal bar is urged upward by springs so that the rigid frame is swingable on the former polygonal bar, a slot is formed in each end of each connecting bar so as to extend longitudinally of the connecting bar, the middle portion of the slot is expanded to form a hole for receiving one end of the polygonal bar perpendicularly to the connecting bar, and the frame is assembled by fitting the respective opposite ends of the polygonal bars into the corresponding holes of the connecting bars and pressing the slotted outer ends of the connecting bars with screws so as to fasten the polygonal bars to the connecting bars.

2. An electromagnetic contactor according to claim 1, wherein said polygonal bars are hexagonal bars.

3. An electromagnetic contactor according to claim 2, wherein said holes formed in the middle portion of the slots of said connecting bars are substantially square holes, respectively.

4. An electromagnetic contactor according to claim 1, wherein each end portion of each said connecting bar is cut to form a clamping section having an upper land, a lower land and a groove formed in the middle portion of the lower land so as to extend widthwise of the connecting bar, one end of said polygonal bar is placed in the groove of the clamping section, a clamping plate having a groove formed so as to correspond to the groove of the clamping section when the same is atttached to the connecting bar is placed on the clamping section with the inner end thereof seated on the upper land and the groove thereof receiving the end of the polygonal bar therein, and the opposite ends thereof are screwed to the clamping section so that the end of the polygonal bar is clamped firmly in the grooves between the clamping section and the clamping plate.

5. An electromagnetic contactor comprising: a base plate; a stand fixed to the base plate; an electromagnet consisting of a fixed core and an operating coil mounted on the fixed core, and disposed within the stand; a plurality of fixed contacts provided in the upper portion of the stand; a supporting case; plurality of crossbars mounted on the supporting case and joined to the same with pins, respectively; a plurality of contact bars associated with the crossbars, respectively, and each provided with a pair of movable contacts so that the movable contacts are located opposite the corresponding fixed contacts, respectively; a movable core disposed within the supporting case and joined to the same with the pins joining the crossbars to the supporting case, so as to be located opposite the fixed core; and a rigid frame consisting of two parallel polygonal bars and two parallel connecting bars interconnecting the respective opposite ends of the polygonal bars, and pivotally supporting the supporting case at the opposite ends of the same, wherein one of the polygonal bars is supported rotatably at the opposite ends thereof in bearings provided on one side of the stand, while the other polygonal bar is urged upward by springs so that the rigid frame is swingable on the former polygonal bar, a slot is formed in each end of each connecting bar so as to extend longitudinally of the connecting bar, the middle portion of the slot is expanded to form a hole for receiving one end of the polygonal bar perpendicularly to the connecting bar, and the frame is assembled by fitting the respective opposite ends of the polygonal bars into the corresponding holes of the connecting bars and pressing the slotted outer ends of the connecting bars with screws so as to fasten the polygonal bars to the connecting bars.

6. An electromagnetic contactor according to claim 5, wherein said polygonal bars are hexagonal bars.

7. An electromagnetic contactor according to claim 5, wherein said holes formed in the middle portion of the slots of said connecting bars are substantially square holes, respectively.

8. An electromagnetic contactor according to claim 5, wherein each end portion of each said connecting bar is cut to form a clamping section having an upper land, a lower land and a groove formed in the middle portion of the lower land so as to extend widthwise of the connecting bar, one end of said polygonal bar is placed in the groove of the clamping section, a clamping plate having a groove formed so as to correspond to the groove of the clamping section when the same is attached to the connecting bar is placed on the clamping section with the inner end thereof seated on the upper land and the groove thereof receiving the end of the polygonal bar therein, and the opposite ends thereof are screwed to the clamping section so that the end of the polygonal bar is clamped firmly in the grooves between the clamping section and the clamping plate.

9. A magnetic contactor according to any one of claims 1 to 8, wherein a hole for receiving the tip of a screwdriver or the like is formed in one of said connecting bar at a position in the vicinity of the junction of the connecting bar and the polygonal bar on the free side of said frame, in order to facilitate the manual turning of said frame to bring the movable contacts manually into contact with the corresponding fixed contacts.

* * * * *